United States Patent [19]

Franks

[11] Patent Number: 4,485,849

[45] Date of Patent: Dec. 4, 1984

[54] LOOM BEAM LET OFF

[76] Inventor: Bobby L. Franks, 3215 Howland, Anderson, S.C. 29646

[21] Appl. No.: 388,034

[22] Filed: Jun. 14, 1982

[51] Int. Cl.[3] ..... D03D 49/08

[52] U.S. Cl. ..... 139/107; 139/109

[58] Field of Search ..... 139/107, 109, 105, 106, 139/108; 188/72.4, 71.7, 72.8, 72.7

[56] References Cited

U.S. PATENT DOCUMENTS 3,033,325 5/1962 Tjernstrom ..... 188/71.7

*Primary Examiner*—Henry S. Jaudon
*Assistant Examiner*—Tracy Graveline
*Attorney, Agent, or Firm*—Bailey & Hardaway

[57] ABSTRACT

A simplified loom beam let off is illustrated which utilizes a brake disc with opposed brake pads for applying uniform tension to the yarn through the loom beam gear. The pads are urged through yieldable force against the disc and such force may be adjusted manually or automatically through sensors responsive to tension in the warp or responsive to size of the build on the loom beam.

1 Claim, 5 Drawing Figures

Fig. 1.
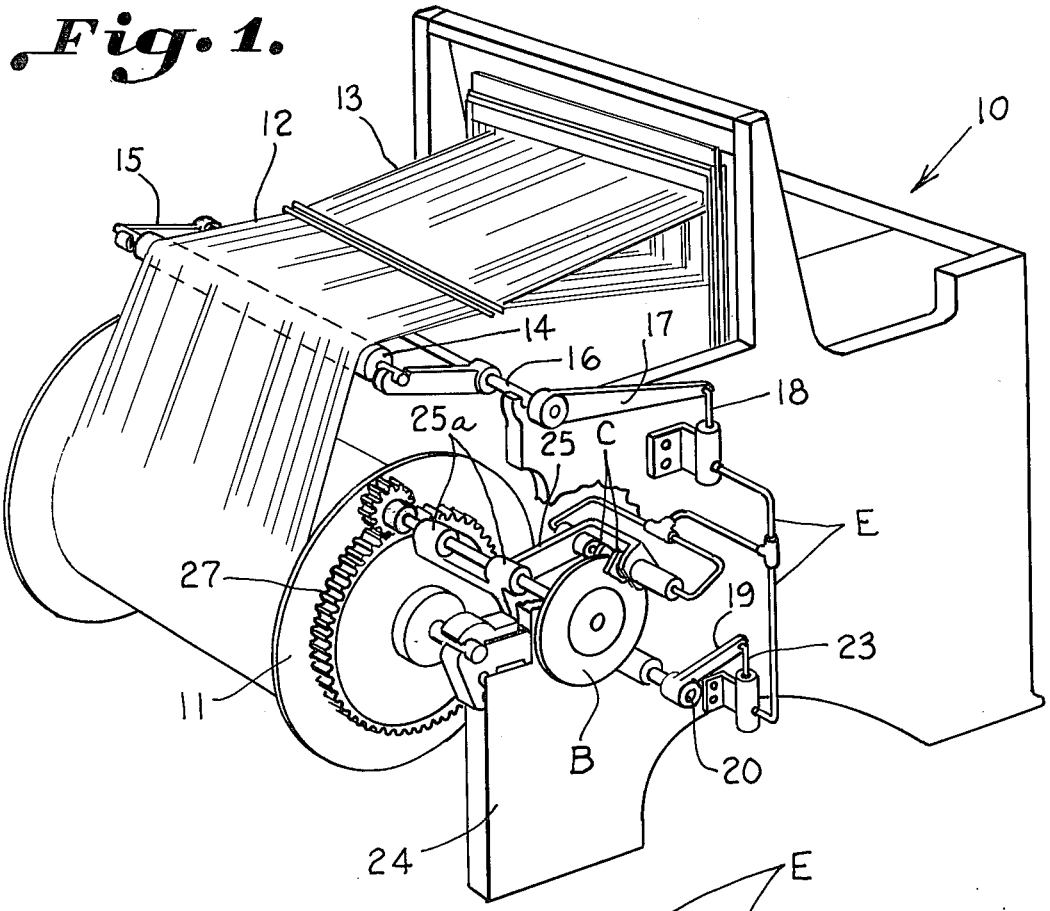
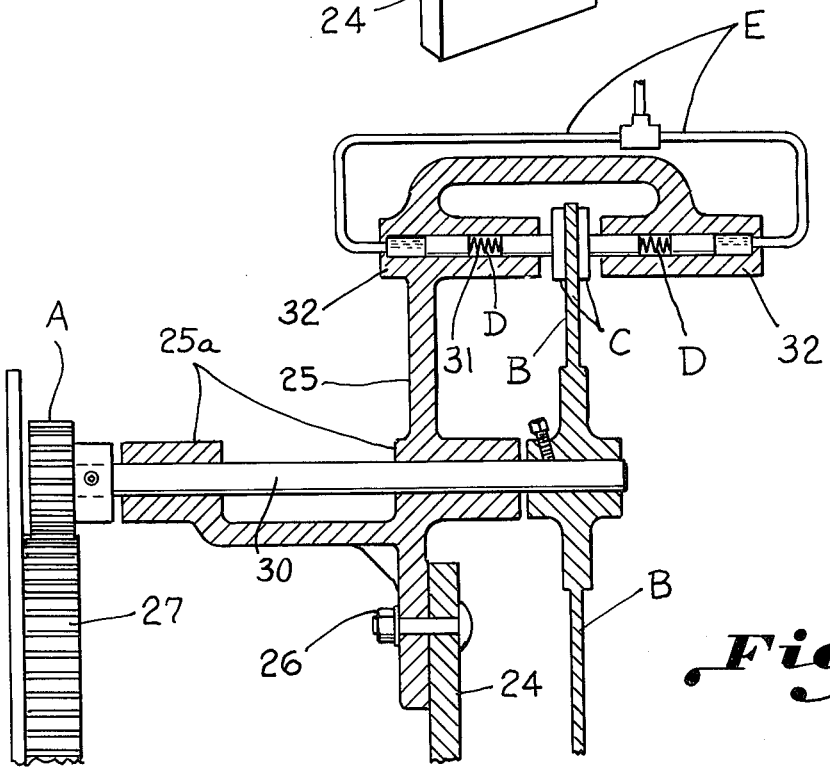
Fig. 2.

Fig. 3.
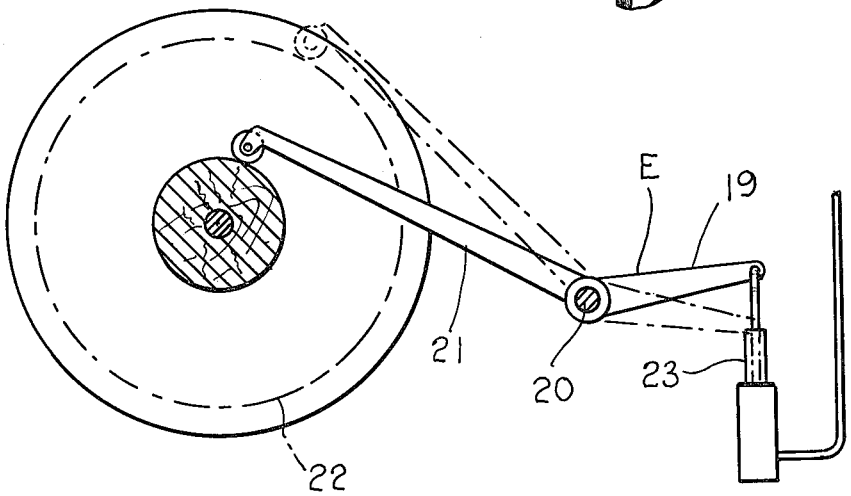
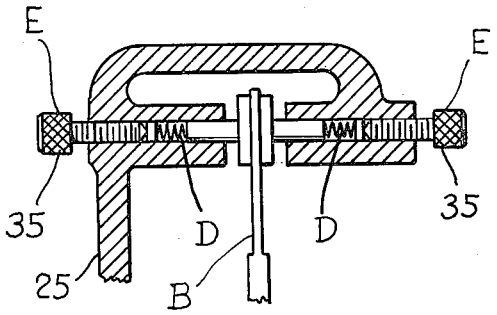
Fig. 4.
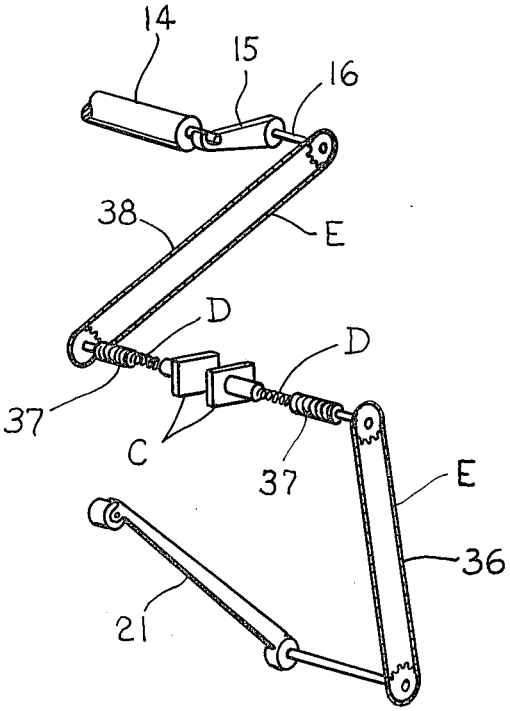
Fig. 5.

LOOM BEAM LET OFF

BACKGROUND OF THE INVENTION

The most widely accepted loom beam let off utilized by the textile industry is the "Hunt" let off, generally illustrated in at least one version in U.S. Pat. No. 3,255,784. Such let offs are relatively complicated and, although means is provided for automatic sheave adjustments responsive to variations in yarn tension and beam size, weights must be manually adjusted periodically during the depletion of yarn build from the loom beam.

Accordingly, an important object of this invention is the provision of a simplified let off utilizing a simple braking structure which is subject to easy adjustments to exert varying the amounts of drag afforded thereby to tension the warp yarn with a view to compensating for variations in yarn tension during running of a loom beam.

The use of drum brake means in relatively complicated let offs is illustrated in U.S. Pat. Nos. 2,441,680 and 3,749,136. However, the braking apparatus of the present invention contemplates what are generally known as caliper brakes utilizing a disc with opposed pads for generating a drag. A simplified let off results through the avoidance of complicated gearing as made possible through the use of disc and pads.

SUMMARY OF THE INVENTION

It has been found that a simplified let off may be constructed utilizing a caliper brake arrangement wherein a disc brake assembly is attached through a shaft and pinion to the loom gear. Control means is provided which may be either manually adjustable or adjustable responsive to tension in the warp yarn and to the size of the build on the loom beam.

BRIEF DESCRIPTION OF THE DRAWINGS

The construction designed to carry out the invention will be hereinafter described, together with other features thereof.

The invention will be more readily understood from a reading of the following specifications and by reference to the accompanying drawings forming a part thereof, wherein an example of the invention is shown and wherein:

FIG. 1 is a perspective view illustrating a loom beam equipped with a let off constructed in accordance with the present invention illustrating the caliper disc brake arrangement which may be actuated in response to movement of the whip roll as well as variation or reduction in size of the build of yarn on the loom beam, FIG. 2 is a transverse sectional elevation illustrating the mounting means for the disc with tension adjusting means in section, FIG. 3 is a side elevation illustrating sensing means controlling drag exerted by the disc responsive to the size of the build on the loom beam, FIG. 4 is a transverse sectional elevation similar to FIG. 2 illustrating the modified form of the invention wherein threaded means are provided for manual adjustment of the force exerted by the springs against the pad means for varying the tension on the warp yarn through a series of manual adjustments made at predetermined times during the running of the loom beam, and FIG. 5 is a schematic perspective view illustrating an alternate form of invention wherein mechanical drives rather than hydraulic means are utilized for varying the yieldable force exerted by the springs against the pads and the discs.

DESCRIPTION OF A PREFERRED EMBODIMENT

The drawings illustrate a let off for a loom having a beam provided with a beam gear delivering warp yarn under tension for weaving. A pinion A is driven by the beam gear. A brake disc B is driven by the pinion. A pair of opposed brake pads C engages the disc. A spring D exerting a resilient force urges each of the pads against the disc. Means E are provided for adjusting the resilient force exerted against the pads. Such means maybe provided for adjusting springs which apply the resilient force responsive to tension on the warp yarn, and responsive to variation in size of yarn build on the loom beam. A drive shaft extends between the pinion and the disc, and a mounting bracket carries the shaft adjacent the loom beam.

Referring more particularly to FIG. 1, a loom is broadly designated at 10. The loom has a loom beam 11 for feeding warp yarns 12 for formation into the usual shead 13 during weaving. The warp yarns are fed from the loom beam 11 over the usual whip roll 14. The whip roll maybe mounted on the usual pivoted linkage means 15 which is deflected responsive to tension on the warp yarn which is in turn translated through a suitable shape 16 to linking means 17 which in turn raises a plunger or piston 18 to reduce pressure on the fluid of the hydraulic system. The drawings illustrate the use of a link 19 which is pivoted on a shaft 20. Responsive to movement of a sensor or follower arm 21 as the yarn 22 (FIG. 3) which constitutes the build is depleted during weaving. The decreasing diameter of the loom beam lowers the follower arm 21 and raises the piston or plunger 23 to likewise reduce pressure in the system.

In FIG. 2 fluid operated pistons are illustrated between the lines E and the springs D in a cylinder provided therefore. A plunger is illustrated between the springs D and the pads C for transmitting the force developed by the compressed springs to the pads.

The loom 10 in FIG. 2 is illustrated as including a side frame member portion 24 to which a bracket 25 is suitably attached by bolts 26.

The let off includes a pinion A which is carried by the loom beam gear 27. The bracket 25 has a bearing **25*a* which is carried by the shaft 30 connecting the pinion A and the disc member B. The shaft is mounted in the bearing 25*a* and the pads C are actuated through the raising and lowering of the pistons 18 and 23 respectively to control pressure on the fluid and the means E which are provided for adjusting the resilient force exerted against the pads C. Means D which provide a yielding force includes the springs 31 as well as the cylinder 32**.

FIG. 4 illustrates a modified form of the invention wherein the means E are provided in the form of threaded members 35 for manually adjusting the force exerted by the springs through the pads C against the disc B. Plungers are illustrated in FIG. 4 between the threaded members and the springs D and also between the springs D and the brake pads.

An alternate form of the invention illustrated in FIG. 5 may include the use of a chain 36 driven by the follower arm 21 in order to turn a screw threaded means 37 for adjusting the yielding force exerted by the spring D on one of the pads C (FIG. 5). The chain 38 is illustrated as being driven responsive to oscillations of the link 15 which is raised and lowered responsive to movements of the whip roll which result from variations in tension of the warp yarn to operate a similar screw threaded means to adjust the force exerted by the other of the pads C.

It is thus seen that a simplified let off has been provided which utilizes a simple braking arrangement. Such may be inexpensively constructed for exerting highly controllable tension upon the warp yarn through mechanical expediences which require minimum maintenance.

While preferred embodiment of the invention has been described using specific terms, such description is for illustrative purposes only, and it is to be understood that changes and variations may be made without departing from the spirit or scope of the following claims.

What is claimed is:

1. A let off for a loom having a loom beam delivering warp yarn under tension for weaving and a beam gear comprising:

a pinion driven by said beam gear;

a brake disc driven by said pinion;

a pair of opposed brake pads engaging said disc;

springs continuously during weaving exerting an adjustable yielding force against said pads, urging each of said pads against said disc, and imparting an adjustable tension to the warp yarn being removed from the loom beam;

means, acting in response to changing warp conditions, adjusting the force of said springs and thereby adjusting the yielding force exerted against said pads;

a drive shaft extending between said pinion and said disc; and a mounting bracket carrying said shaft adjacent said loom beam.

* * * * *